US009393577B2

(12) United States Patent
Hodotsuka

(10) Patent No.: US 9,393,577 B2
(45) Date of Patent: Jul. 19, 2016

(54) CENTRIFUGE WITH TEMPERATURE CONTROL

(71) Applicant: HITACHI KOKI CO., LTD., Tokyo (JP)

(72) Inventor: Yuki Hodotsuka, Hitachinaka (JP)

(73) Assignee: HITACHI KOKI CO., LTD., Tokyo (JP)

( * ) Notice: Subject to any disclaimer, the term of this patent is extended or adjusted under 35 U.S.C. 154(b) by 464 days.

(21) Appl. No.: 14/069,230

(22) Filed: Oct. 31, 2013

(65) Prior Publication Data

US 2014/0121094 A1 May 1, 2014

(30) Foreign Application Priority Data

Oct. 31, 2012 (JP) ..... 2012-241245

(51) Int. Cl.
*B04B 13/00* (2006.01)
*B04B 15/02* (2006.01)
*B04B 9/10* (2006.01)

(52) U.S. Cl.
CPC . *B04B 9/10* (2013.01); *B04B 13/00* (2013.01); *B04B 13/003* (2013.01); *B04B 15/02* (2013.01)

(58) Field of Classification Search
CPC ..... B04B 9/10; B04B 15/02; B04B 13/00; B04B 13/003
USPC ..... 494/1, 7–11, 13–14, 16–21, 60–61, 84
See application file for complete search history.

(56) References Cited

U.S. PATENT DOCUMENTS 5,431,620 A * 7/1995 Schenck ..... B04B 13/003 210/145
6,866,621 B1 * 3/2005 Muller ..... B04B 15/02 494/14
2008/0174909 A1 * 7/2008 Ohkawara ..... B04B 15/02 360/97.12
2011/0021332 A1 * 1/2011 Akatsu ..... B04B 15/02 494/1
2011/0207590 A1 * 8/2011 Ooyama ..... B04B 9/10 494/9
2012/0260687 A1 * 10/2012 Inaniwa ..... B04B 9/10 62/196.1
2013/0190159 A1 * 7/2013 Watahiki ..... B04B 13/00 494/11
2014/0024516 A1 * 1/2014 Kusumoto ..... B04B 13/00 494/1
2014/0031191 A1 * 1/2014 Inaniwa ..... B04B 9/10 494/9
2014/0045669 A1 * 2/2014 Osawa ..... B04B 9/10 494/9
2014/0121094 A1 * 5/2014 Hodotsuka ..... B04B 9/10 494/7

FOREIGN PATENT DOCUMENTS

DE 3630483 A1 * 6/1987 ..... B04B 13/00
DE 3632087 A1 * 7/1987 ..... B04B 15/02
JP 1-218651 A 8/1989

* cited by examiner

*Primary Examiner* — Charles Cooley
(74) *Attorney, Agent, or Firm* — McDermott Will & Emery LLP

(57) ABSTRACT

Lowering of process quality of a sample is prevented even when a rotor is slowly decelerated taking a long time upon finishing a centrifugal process. A centrifuge having a steady operation mode of rotating a rotor at an inputted steady rotation speed and a deceleration stop mode of stopping the rotor by deceleration. When a remaining time of the steady operation mode is within a stop preparation time, a target controlled temperature of the rotor chamber is set from a first target controlled temperature to a second target controlled temperature that is higher than the first target controlled temperature. By setting the target controlled temperature of the rotor chamber high before switching to the deceleration stop mode, temperature of the rotor chamber is controlled to be close to a set temperature of the rotor and thus excessive cooling of a sample loaded to the rotor can be prevented.

13 Claims, 6 Drawing Sheets

CENTRIFUGE WITH TEMPERATURE CONTROL

CROSS-REFERENCE TO RELATED APPLICATION

The present application claims priority from Japanese Patent Application No. 2012-241245 filed on Oct. 31, 2012, the content of which is hereby incorporated by reference into this application.

TECHNICAL FIELD OF THE INVENTION

The present invention relates to a centrifuge, when takes liquids or a mixture of solids and liquids as sample, for a variety of centrifuging such as sedimentation isolation, purification, concentration to process the sample with centrifugal force.

BACKGROUND OF THE INVENTION

In the fields such as medical and pharmaceutical sciences and gene engineering, a centrifugal precipitator that is a centrifuge is used to process by, for example, sedimentation isolation in this taking a sample of liquids or a mixture of solids and liquids as a sample. A centrifuge has installed therein a rotor to which a container, such as tube or bottle, in which samples such as culture broth or blood is accommodated is loaded. The rotor is detachably loaded to a rotation axis that protrudes into a rotor chamber (rotary chamber) of a storage container. The rotor is driven to rotate with a driving device such as electric motor. Upon a centrifuging process on a sample in the storing container, the rotor is rotated at a high speed in the state where the sample is retained by the rotor.

The centrifuge in which a maximum speed of rotation of a rotor is set at about from 10,000 to 30,000 rpm is often used to process a sample while putting its rotor chamber at an atmospheric pressure. When a rotor is rotated in this manner in which air exists in the rotor chamber, heat of friction of air and the rotor generated during the rotation of the rotor may be bigger and it might rise the temperature of the sample. Therefore, a cooling apparatus is often mounted in a centrifuge. As the cooling apparatus, for example, a refrigerator (freezing machine) in which a cooling medium is circulated in a cooling pipe that is wound around a storing container is used as described in Japanese Patent Application Laid-Open Publication No. H01-218651.

In a centrifuge in which a cooling apparatus is mounted, operating conditions are set by inputting them by a user via an input-operation panel of the centrifuge. There are operation conditions such as a rotation speed of a rotor, that is, number of rotation, operation time of the centrifuge, that is, processing time, set temperature of the rotor, that is, cooling temperature, acceleration gradient upon start-up of the rotor, deceleration gradient upon stopping deceleration of the rotor, and so forth.

When subjecting a sample to a centrifugal process, a rotor to which the sample is loaded is attached to a rotation axis to set the rotor in a rotor chamber. After setting the rotor, an operator closes a door provided to the centrifuge and pushes a start switch on an operation panel and then the rotor is activated and rotation is started. As the rotor is accelerated, when the speed reaches the set rotation speed, the rotor is operated by a constant-velocity drive at a steady speed. When a set operation time is elapsed as the steady-speed operation of the rotor is continued, the rotation of the rotor is decelerated and the rotor is stopped. Thereafter, the user opens the door to get the rotor out of the centrifuge and get the sample after the centrifugal process of the rotor.

The refrigerator used as a cooling apparatus cools the rotor chamber by driving a motor of a compressor for sending out a coolant to circulatory supply the coolant in a cooling pipe. The compressor used in the centrifuge is normally operated at a steady speed at a commercially used power frequency, that is, 50 Hz or 60 Hz. The rotation control of the compressor is generally performed in the following manner. First, the compressor is driven until the rotor is cooled down to a set temperature and when the temperature of the rotor reaches the set temperature, the compressor is stopped. When the temperature starts to rise as heat is generated from the rotor due to friction with the air etc., the compressor is driven again.

Variety of rotors are loaded on one centrifuge and the most optimum one of the variety of rotors is selected depending on the sample to be subjected to a centrifugal process and/or separating conditions. The operating conditions of the centrifuge differ depending on the selected rotor. A rotation speed of the rotor to be set, that is, the number of rotation are various from a high speed to a low speed, and through all the conditions, the centrifuge is required to cool the rotor at a set temperature. As the rotor itself generates heat due to heat of friction with the air caused by rotation of the rotor as mentioned above, a difference is made between the temperature of the rotor and the temperature of the rotor chamber that is detected by a temperature sensor provided inside the rotor chamber. Generally, the temperature of the rotor is higher than the temperature of the rotor chamber. Thus, to maintain the rotor at the set temperature, a target controlled temperature is set including corrected temperature difference between the temperature of the rotor and the temperature of the rotor chamber and the temperature of the rotor chamber is controlled so as to obtain the target controlled temperature.

The amount of heat generation, that is, windage loss of the rotor is increased as the rotation speed of the rotor is increased. Particularly, as to windage loss at the maximum rotation speed of the rotor, an increase of the amount of heat generation of the rotor is significant upon operating the centrifuge at a set rotation speed that is higher than or equal to 48% of the maximum rotation speed. The larger the amount of heat generation of the rotor, the higher the temperature of the rotor itself, and it makes the temperature difference of the rotor and the rotor chamber larger and also the corrected amount becomes larger. Thus, the higher the rotation speed of the rotor during operation is, the more the target controlled temperature of the rotor chamber is set to be significantly lower than the set temperature of the rotor.

As methods of decelerating a rotor in a centrifuge, there are: decelerating at the maximum capacity; free-run (natural deceleration) deceleration control for decelerating only by the resistance of windage loss generated in the rotor or mechanical loss inside a motor without braking by the motor; and slow deceleration control for slowly decelerating taking a long time with setting a deceleration gradient. The latter two of the methods are used when separating a sample in which a pellet (solid matter having a heavy specific gravity) being settled out at the bottom portion of a sample container is prone to go up into a supernatant liquid. Upon finishing a centrifugal process, in the case of performing the decelerating stop control like the free-run deceleration control or the slow deceleration control, the higher the rotation speed or the larger the volume of the rotor is, the more the deceleration takes time. When decelerating from the setting rotation speed that is 48% of the maximum rotation speed taking time, the rotor is accommodated for a long time in the rotor chamber that is cooler than the set temperature since the target controlled temperature is set at a lower temperature than the set temperature. When the rotation speed of the rotor is lowered while this state is being kept, the amount of heat generation of the rotor is gradually decreased. However, as a centrifuge not mounting a heating apparatus cannot raise the temperature of the rotor chamber, the temperature of the sample loaded in the rotor is considerably lower than the set temperature, resulting in excessive cooling (icing) of the sample. When excessive cooling happens, the quality of the centrifugal process of the sample is lowered.

A preferred aim of the present invention is to provide a centrifuge capable of preventing lowering of process quality of the sample even when the rotation of the rotor is slowly decelerated with taking time upon stopping a centrifugal process.

SUMMARY OF THE INVENTION

A centrifuge according to the present invention includes: a rotor chamber containing a rotor in which a sample is loaded; a motor rotary driving the rotor; a cooling unit cooling temperature of the rotor chamber; a temperature sensor detecting the temperature of the rotor chamber; an input unit inputting operation conditions of the rotor; and a control unit controlling the motor in a steady operation mode of rotating the rotor at a setting rotation speed and for a setting time inputted by the input unit and a deceleration stop mode of stopping the rotor by deceleration after the steady operation mode is finished. In the centrifuge, the control unit controls the cooling unit such that, when the setting rotation speed is higher or equal to a predetermined value, a target controlled temperature of the rotor chamber is set from a first target controlled temperature to a second target controlled temperature that is higher than the first target controlled temperature before starting deceleration of the rotor.

In the centrifuge according to the present invention, changes in the target controlled temperature made by the control unit is performed only when the set temperature inputted by the input unit is lower than or equal to a predetermined value. In the centrifuge according to the present invention, when the setting rotation speed becomes 40% or more of a maximum rotation speed, the first target controlled temperature is changed to the second target controlled temperature. In the centrifuge according to the present invention, the cooling unit includes a compressor which compresses a cooling medium flowed out from a cooling pipe in which the cooling medium is circulated, and controls the temperature of the rotor by changing a rotation speed of the compressor. In the centrifuge according to the present invention, the cooling unit includes a cooling pipe in which a cooling medium is circulated, and a circulating pipe sending back the cooling medium flowed out from an outlet port of the cooling pipe to an inlet port of the cooling pipe via the compressor, a bypass pipe bypassing the compressor is provided to the circulating pipe, and the temperature of the rotor chamber is controlled by adjusting a flow rate of the bypass pipe. In the centrifuge according to the present invention, a rotation axis of the motor has a rotor identifier for identifying a type of the rotor attached to the rotation axis, and when windage loss calculated from the type of the rotor and the rotation speed of the rotor is larger than or equal to allowable windage loss limit value to windage loss of a maximum rotation speed of the rotor, the temperature of the rotor chamber is set at the second target controlled temperature. In the centrifuge according to the present invention, when the rotor is driven at a revolution speed higher than or equal to a limit rotation speed, the temperature of the rotor chamber is set to the second target controlled temperature. In the centrifuge according to the present invention, based on the type of the rotor and the rotation speed of the rotor, a stop preparation time in which the first target controlled temperature is switched to the second target controlled temperature and the second target controlled temperature are calculated. In the centrifuge according to the present invention, the rotation axis of the motor has a rotor identifier for identifying a type of the rotor attached to the rotation axis, and when the rotation speed of the rotor is higher than or equal to a predetermined value, the temperature of the rotor chamber is set to the second target controlled temperature based on the type and the setting rotation speed.

A centrifuge according to the present invention includes: a rotor chamber containing a rotor in which a sample is loaded; a motor rotary driving the rotor; a cooling unit cooling temperature of the rotor chamber; a temperature sensor detecting the temperature of the rotor chamber; an input unit inputting operation conditions of the rotor; and a control unit controlling the motor in a steady operation mode of rotating the rotor at a setting rotation speed and a setting time inputted by the input unit and a deceleration stop mode of stopping the rotor by deceleration after the steady operation mode is finished. In the centrifuge, the control unit sets, when the setting rotation speed is higher than or equal to a predetermined value, a cooling temperature of the rotor chamber to be different between an initial stage of operation and a final stage of operation at an identical rotation speed.

A centrifuge according to the present invention includes: a rotor chamber containing a rotor in which a sample is loaded; a motor rotary driving the rotor; a rotor determining unit determining the rotor; a cooling unit cooling temperature of the rotor chamber; a temperature sensor detecting the temperature of the rotor chamber; an input unit inputting operation conditions of the rotor; and a control unit controlling the motor in a steady operation mode of rotating the rotor at a setting rotation speed and a setting time inputted by the input unit and a deceleration stop mode of stopping the rotor by deceleration after the steady operation mode is finished. The control unit controls the cooling unit such that a target controlled temperature of the rotor chamber is set at a second target controlled temperature that is higher than a first target controlled temperature from the first target controlled temperature before starting deceleration of the motor, in accordance with the type of the rotor determined by the rotor determination unit. In the centrifuge, when the setting rotation speed inputted by the input unit is determined to be 40% or more of a maximum rotation speed of the rotor, the target controlled temperature is changed. In the centrifuge according to the present invention, the control unit changes the target controlled temperature when the rotor determining unit determines that a windage loss of the rotor is small and a deceleration control is a free-run deceleration control or a slow deceleration control.

In the centrifuge according to the present invention, when a remaining time of the steady operation mode rotating the rotor at a steady rotation speed is within a preset stop preparation time, the target controlled temperature of the rotor chamber is set from the first target controlled temperature in the steady operation mode to the second target controlled temperature that is higher than the first target controlled temperature. In this manner, the temperature of the rotor chamber in the deceleration stop mode can be controlled to be a temperature close to the set temperature of the rotor, and excessive cooling of the sample loaded in the rotor can be prevented. Therefore, even when the rotor is slowly decelerated taking a longtime upon stopping a centrifugal process, lowering of process quality of the sample can be prevented.

BRIEF DESCRIPTIONS OF THE DRAWINGS

Figure 7A:
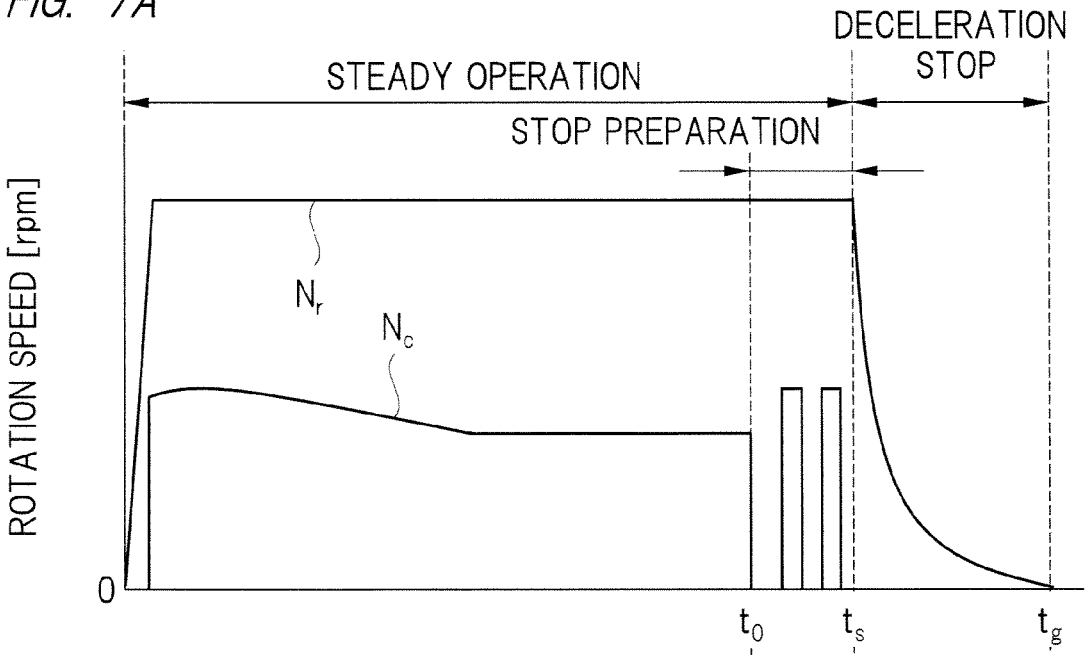
FIG. 7A is an operation mode characteristics diagram illustrating changes in an operation mode of a rotor of a centrifuge of an embodiment in which time changes of a rotation speed of the rotor and a rotation speed of a compressor from start to finish of a centrifugal process.
Figure 7B:
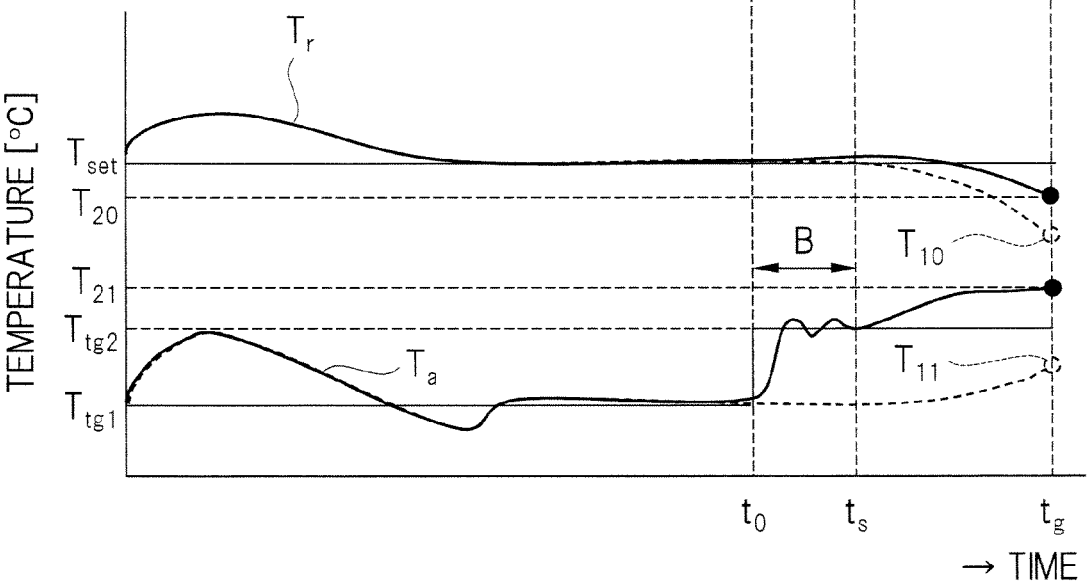
Figure 8:
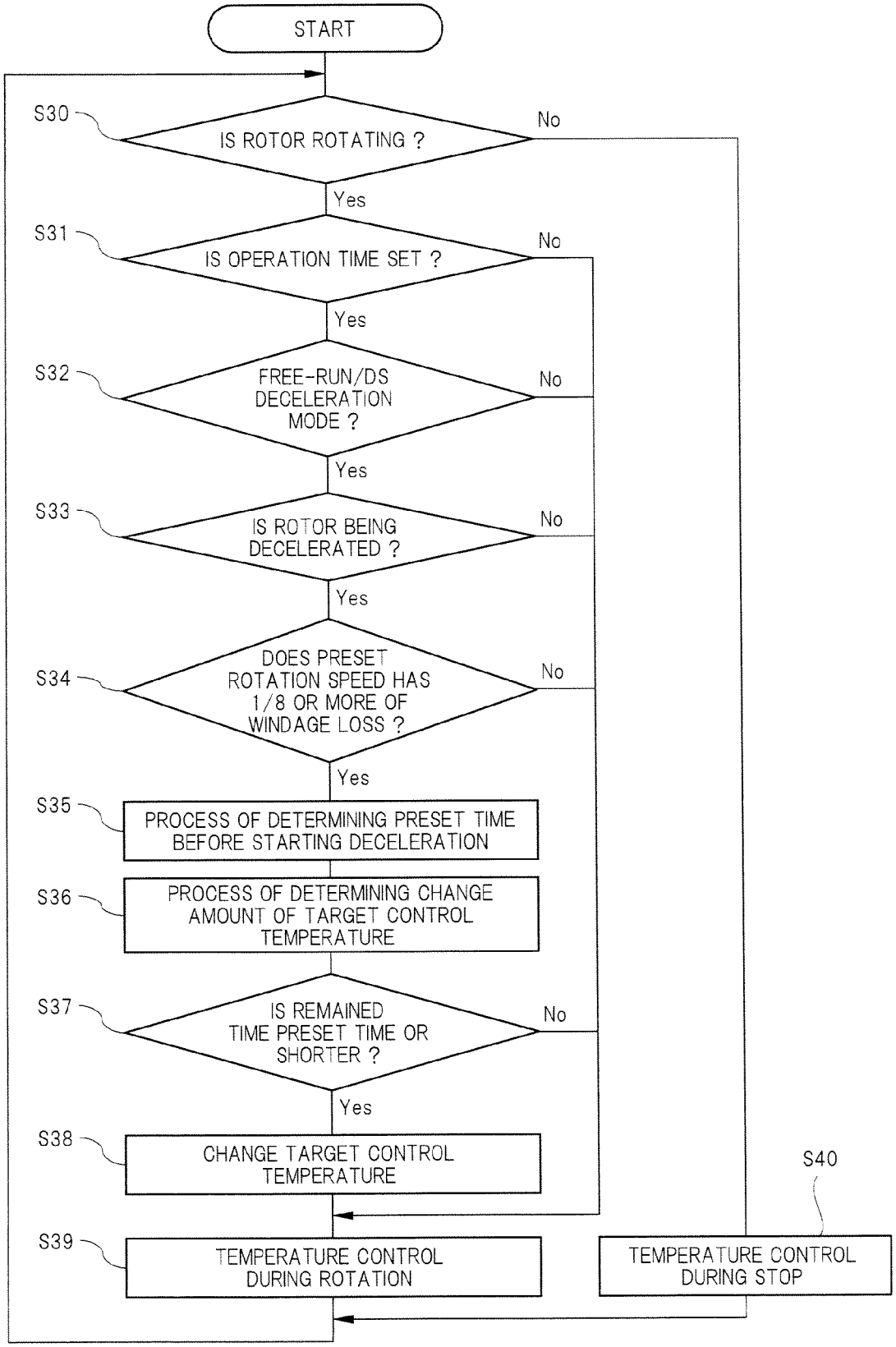

FIG. 7B is an operation mode characteristics diagram illustrating changes in the temperature control operation of a rotor chamber in the centrifuge of the embodiment in which time changes of temperature of the rotor chamber and temperature of the rotor by a temperature control operation from start to finish of the centrifugal process; and FIG. 8 is a flow chart illustrating a control algorithm of the centrifuge of an embodiment.

DESCRIPTIONS OF THE PREFERRED EMBODIMENTS

Hereinafter, embodiments of the present invention will be described in detail with reference to the accompanying drawings. A centrifugal separator, that is, a centrifuge 10 illustrated in FIG. 1 includes a frame 11 in a substantially cuboid shape formed of a box-form plate (sheet metal) or the like. Inside the frame 11, a bowl, that is, a storage container 12 formed of a metal thin plate is provided, and the inside of the container 12 is a rotor chamber 13. Inside the rotor chamber 13, a rotating body, that is, a rotor 14 is disposed. At a bottom portion of the storage container 12, a penetrating hole communicating the inside and outside of the rotor chamber 13 is provided, and a rotation axis 16 of an electric motor 15 as a driving unit penetrates the penetrating hole. The rotor 14 is detachably attached to a rotation axis 16 and driven to rotate by the electric motor 15. The electric motor 15 is controlled at an optional rotation speedup to, for example, 22,000 rpm maximum, and the rotor 14 is driven to rotate at a speed same as that of the rotation axis 16. Note that, in an aspect of connecting a vacuum pump not illustrated to the rotor chamber 13 via a pipe, the rotor 13 can be depressurized upon operating the rotor 14.

The large number of rotors 14 are prepared corresponding to samples to be subjected to centrifugal processes and each of the prepared rotors 14 is attached to the rotation axis 16. Assuming that the rotor 14 illustrated is an angle rotor, a plurality of loading portions, each of which is for loading a container such as a tube in which a sample is accommodated, are formed in a circumferential direction at a distance from each other. To the rotor 14, a rotor cover not illustrated is attached to be freely opened and closed. At a tip portion of the rotation axis 16, an attaching portion which is fitted with an attaching hole of the rotor 14 is provided, and a rotor identifier 14a is provided to a bottom portion of the rotor 14. Note that, to the storage container 12 at a position facing the rotor identifier 14*a*, a rotor-identifier detecting sensor 30 that is a rotor determination unit is disposed. An upper end portion of the storage container 12 is an opening portion and a door 17 for opening and closing the opening portion is attached to the frame 11. In a state of opening the door 17, into and from the inside the rotor chamber 13, the rotor 14 in which a sample(s) to be subjected to a centrifuge process can be inserted and ejected, that is, attached and detached.

To the frame 11, a cooling apparatus 20 is provided as a cooling unit for maintaining the rotor chamber 13 at a desired low temperature. The cooling apparatus 20 includes a cooling pipe 21 wound around the storage container 12, and a circulating pipe 22 connected between an inflow port and an outflow port of the cooling pipe 21. The cooling apparatus 20 is formed of a refrigerator in which a coolant is circulated in the cooling pipe 21 and the circulating pipe 22. A compressor 23 for compressing the coolant in a gas form discharged from the cooling pipe 21 and a condenser (heat exchanger; not illustrated) for cooling and liquidizing the compressed coolant are provided in the same manner as those illustrated in FIG. 2. The cooling pipe 21 and the circulating pipe 22 compose a refrigerating cycle in which the coolant is circulated. In the compressor 23, an electric motor not illustrated is set in as a compressor motor and the compressor 23 can change the rotation speed by an inverter. By changing the rotation speed of the compressor 23, the amount of the coolant circulated and supplied to the cooling pipe 21 is adjusted and the temperature of the rotor 13 is controlled.

Figure 1:
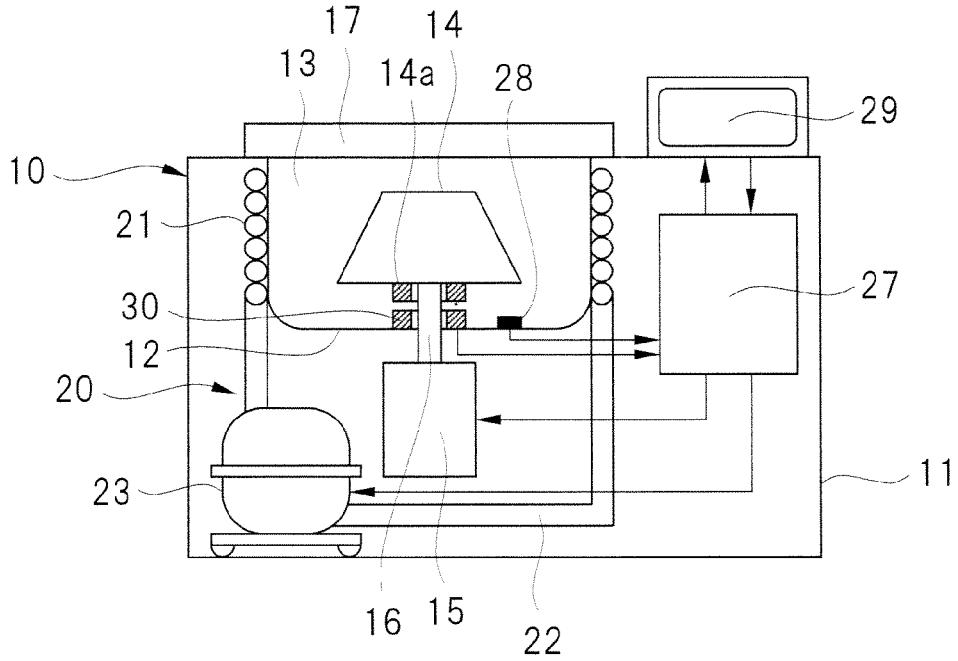
FIG. 1 is a schematic diagram illustrating an example of a centrifuge.
Figure 2:
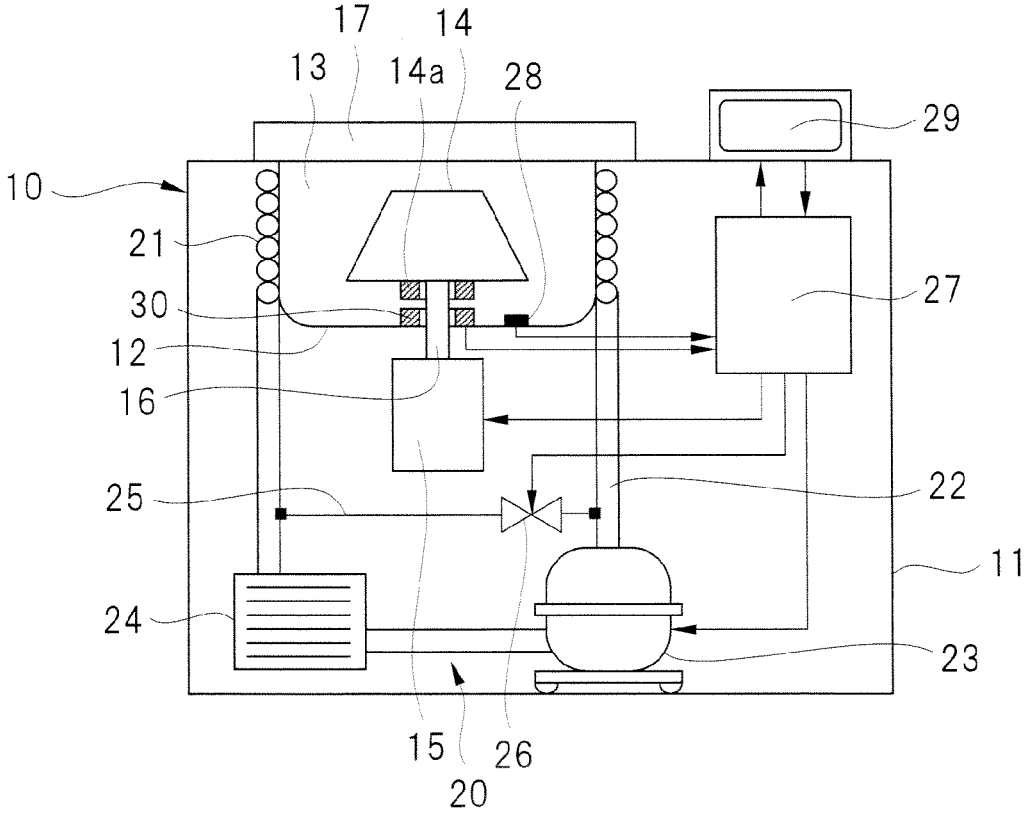
FIG. 2 is a schematic diagram illustrating a centrifuge which is a modification example.

FIG. 2 is a schematic diagram illustrating a centrifuge which is a modification example and members commonly illustrated in FIGS. 1 and 2 are denoted by the same reference numerals.

To the circulating pipe 22 for sending back the coolant flowed out from the outlet port of the cooling pipe 21 to the inlet port of the cooling pipe 21 via the compressor, a heat exchanger for liquidizing the compressed coolant by cooling, that is, a condenser 24 is provided. Between the condenser 24 and the cooling pipe 21 wound around the storage container 12, a bypass pipe 25 bypassing the cooling pipe 21 is provided, and a flow-rate adjusting bulb 26 is provided to the bypass pipe 25. By adjusting the flow rate of the coolant flowing in the bypass pipe 25 by the flow-rate adjusting bulb 26, temperature of the rotor chamber 13 is controlled. In this type of centrifuge 10, without adjusting the rotation speed of the compressor 23, temperature of the rotor chamber 13 can be controlled by the flow-rate adjusting bulb 26. Also, even when a motor speed is made variable by changing the motor of the compressor to an inverter motor and the inverter motor is operated at the lowest rotation speed, more detailed temperature control is available by controlling the flow-rate adjusting bulb 26.

In addition, when the motor is not an inverter motor, the amount of the coolant flowing in the cooling pipe 21 maybe controlled by controlling ON/OFF of the motor or keeping the motor ON.

Inside the frame 11 of the centrifuge 10 illustrated in FIGS. 1 and 2, a control unit 27 as a rotation-axis controlling unit and as a cooling control unit, and the rotation speed of the electric motor 15 as a driving unit for rotary driving of the rotor 14 and the rotation speed of the compressor 23 are controlled by the control unit 27. To the control unit 27, a detection signal is transmitted from a temperature sensor 28 for detecting temperature of the rotor chamber 13 provided to the storage container 12, so that the temperature of the rotor chamber 13 is controlled by feedback-control to be at the target controlled temperature based on the detection signal from the temperature sensor 28. To an upper portion of the frame 11, an operation display area 29 is provided and the operation display area 29 functions as an input unit for inputting information such as operation conditions of the rotor operated by a user, and a function as a display area for displaying needed information.

The control unit 27 includes a microcomputer for calculating a control signal and volatile and non-volatile memories in which control program and data are stored. To the control unit 27, output signals of the above-described temperature sensor 28, a door open/close detecting sensor not illustrated, etc. are inputted. The control unit 27 further has functions of performing rotation control of the electric motor 15 for driving the rotor 14 and rotation of the compressor 23 and also displaying information on the operation display area 29 and acquiring inputted data such as the operation conditions of the centrifuge 10 etc. inputted by operating the operation display area 29, so that the control unit 27 controls the whole of the centrifuge 10.

As the information of the operation conditions of the centrifuge 10 inputted by the user operating the operation display area 29, there are the rotation speed of the rotor 14, operation time of the centrifuge 10, cooling temperature of the rotor 14, gradient of acceleration/deceleration of the rotor 14, and so forth. As the operation display area 29, for example, a liquid crystal display (LED) device of touch-panel system is used; however, other optional display devices and input devices may be used.

The inputted information of the operation conditions of the centrifuge 10 is transmitted to the control unit 27. The control unit 27 performs rotation control of the electric motor 15, temperature control of the rotor chamber 13 by the compressor 23, and display of various information items to the operation display area 29 based on the operation conditions previously stored in the memories and the information of the rotor 14 attached to the rotation axis 16. Such entirely control of the centrifuge 10 is performed with software by executing program stored in the memories on the microcomputer. Note that, the control of the centrifuge 10 is not limited to such control described here.

Figure 3:
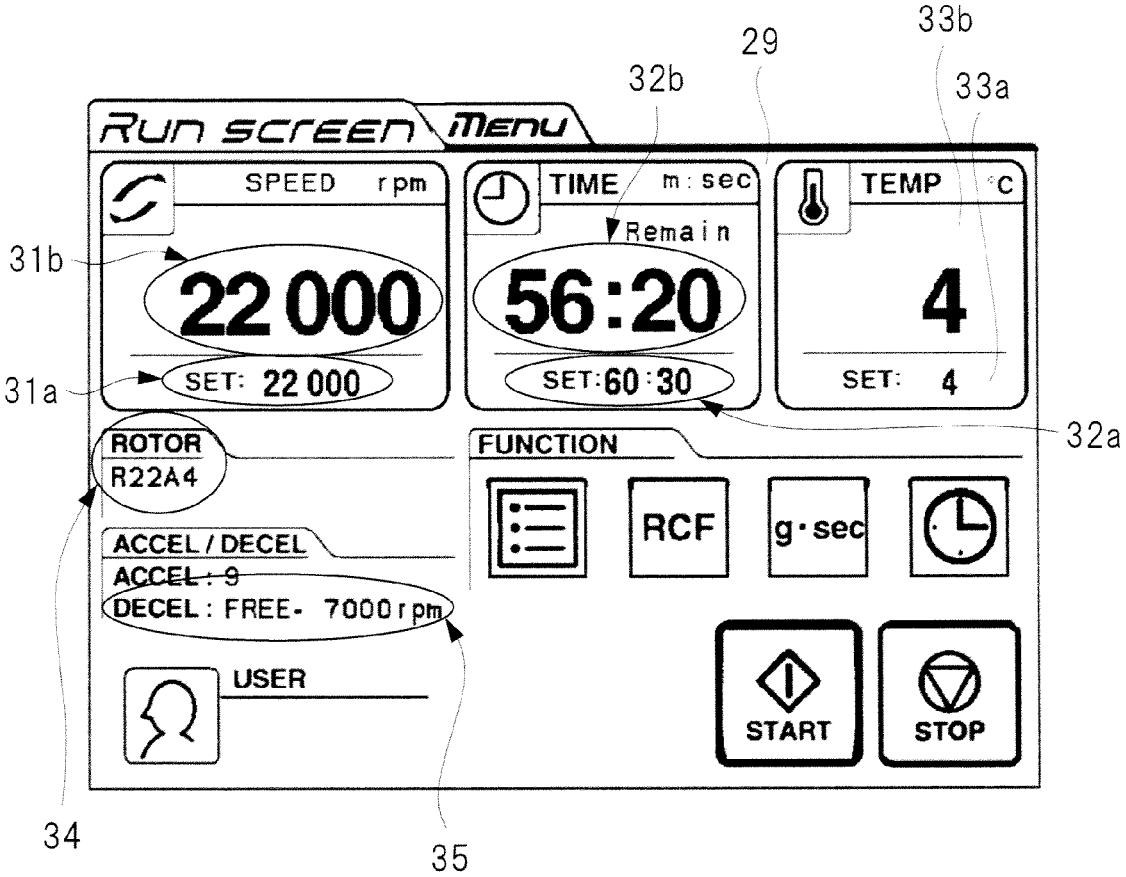
FIG. 3 is a front view illustrating an operation display area provided to the centrifuge.

FIG. 3 is a front view illustrating an example of a display screen of the operation display area 29 in which a display screen during a centrifugal process is illustrated. As illustrated, a setting rotation speed display area 31*a* for displaying a rotation speed of the rotor set by a user and a rotation speed display area 31*b* for displaying an actual rotation speed during a centrifugal process are provided to the operation display area 29. To the operation display area 29, a set operation time display area 32*a* for displaying a set operation time of the centrifuge and a remaining operation time display area 32*b* for displaying a remaining operation time during the centrifugal process are provided. To the operation display area 29, a set temperature display area 33*a* for displaying a set value of a set rotor temperature and a temperature display area 33*b* for displaying temperature of the rotor 14 estimated from a detected temperature of the rotor chamber 13 detected by the temperature sensor 28 are provided. Moreover, to the operation display area 29, a rotor display area 34 for displaying a type of the rotor detected by the rotor identifier attached to the rotation axis 16 and a deceleration mode display area 35 for displaying a deceleration mode inputted by the user are provided. What is displayed on the deceleration mode display area 35 is that a setting is made by the user such that the rotor 14 performs a free-run deceleration control from 7000 rpm, in FIG. 3.

Figure 4:
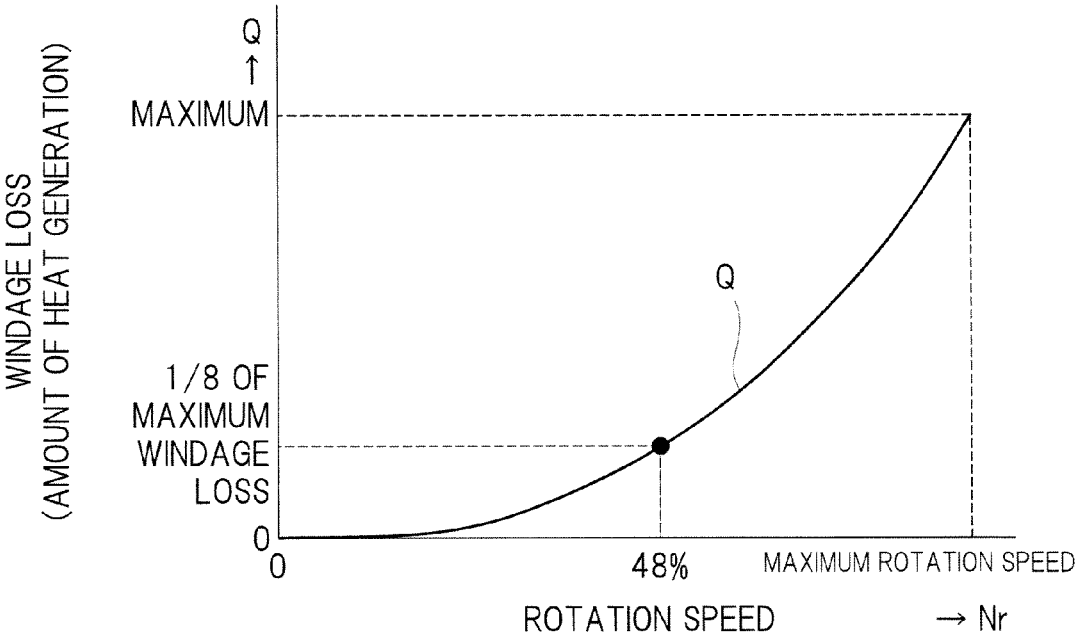
FIG. 4 is a windage loss characteristics diagram illustrating a relationship of a rotation speed of a rotor and windage loss.
Figure 5:
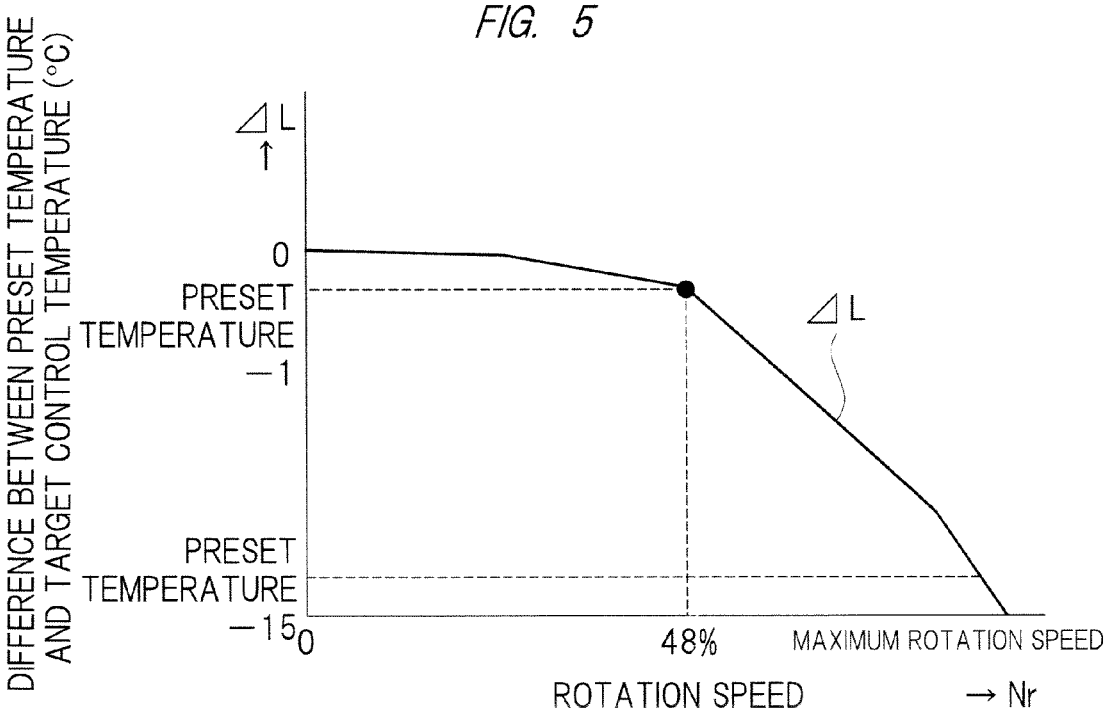
FIG. 5 is a temperature difference characteristics diagram illustrating a change in a temperature difference between a set temperature of the rotor and a target controlled temperature of a rotor chamber to the rotation speed of the rotor.

FIG. 4 is a windage loss characteristics diagram illustrating a relationship of the rotation speed Nr and windage loss Q of the rotor 14. FIG. 5 is a temperature difference characteristic diagram illustrating a change of a temperature difference ΔL of a set temperature of the rotor and a target controlled temperature of the rotor chamber to the rotation speed Nr of the rotor 14.

As illustrated in FIG. 4, the amount of heat generation, that is, windage loss Q of the rotor 14 due to heat of friction with the air caused by rotation of the rotor 14 increases as the rotation speed Nr of the rotor is increased. Particularly, an increase of the amount of heat generation of the rotor is significant when operating the centrifuge at a rotation speed set to be higher than a rotation speed having a windage loss allowable limit value that is larger than or equal to 48% (windage loss value that is about ⅛ (one-eighth) of the windage loss Q at the highest rotation speed of the rotor) of the highest rotation speed. As illustrated in FIG. 4, when the windage loss Q is increased, temperature of the rotor itself is increased and thus the temperature difference ΔL of the rotor 14 and the rotor chamber 13 is increased. Thus, as illustrated in FIG. 5, the higher the rotation speed of the rotor 14 during operation, the more the target controlled temperature of the rotor chamber 13 being corrected to be significantly lower than the set temperature of the rotor 14.

Figure 6A:
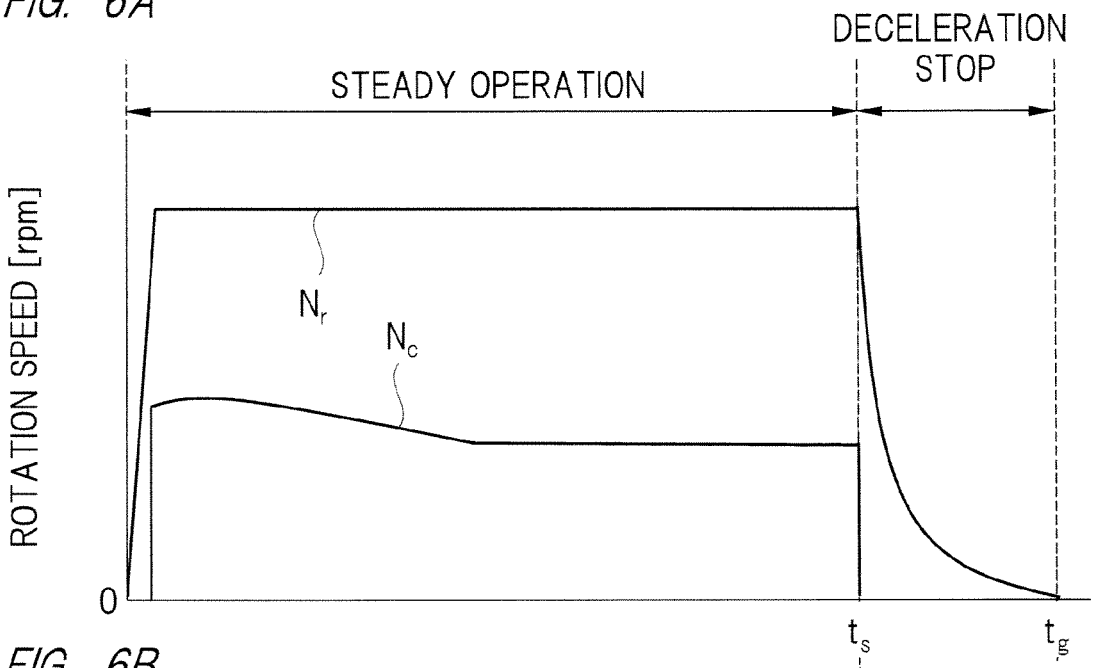
FIG. 6A is an operation mode characteristics diagram illustrating changes in an operation mode of a rotor of an existing centrifuge as a comparative example in which time changes of a rotation speed of the rotor and a rotation speed of a compressor from start to finish of a centrifugal process.
Figure 6B:
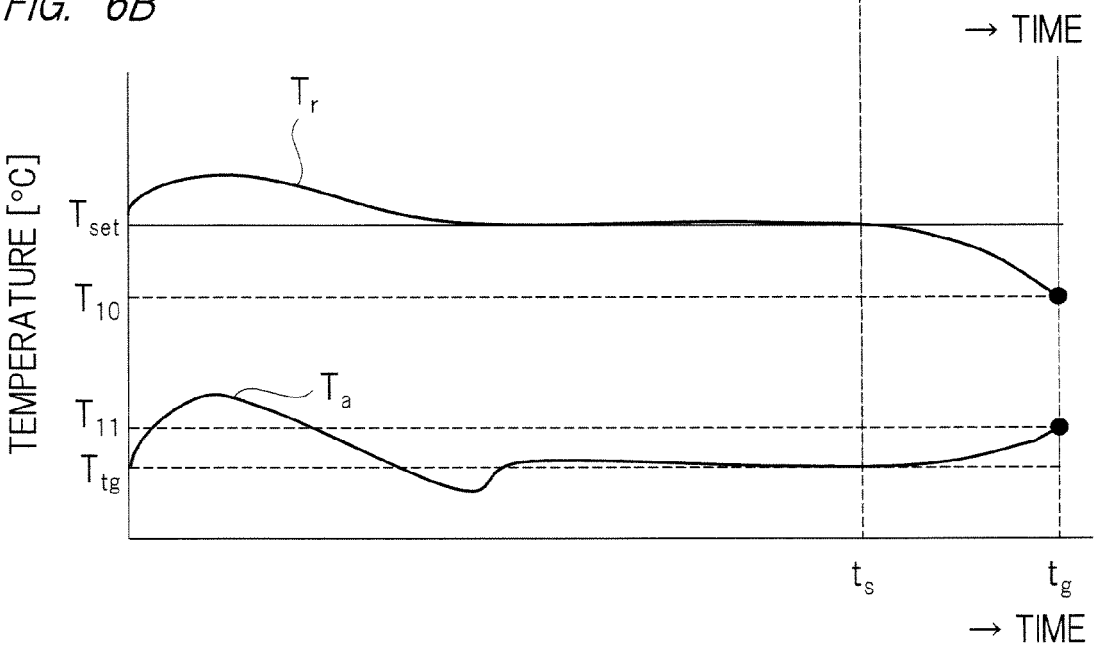
FIG. 6B is an operation mode characteristics diagram illustrating changes in the temperature control operation of a rotor chamber in the existing centrifuge as the comparative example in which time changes of temperature of the rotor chamber and temperature of the rotor by a temperature control operation from start to finish of the centrifugal process.

FIGS. 6A and 6B are operation mode characteristics diagrams as a comparative example illustrating changes in a temperature control operation of the rotor chamber 13 and an operation mode of the rotor 14 of an existing centrifuge. FIG. 6A illustrates time changes of a rotation speed Nr of the rotor 14 and a rotation speed Nc of the compressor 23 from the start to finish of a centrifugal process. FIG. 6B illustrates changes of temperature Ta of the rotor chamber 13 and temperature Tr of the rotor 14 in a temperature control operation from the start to finish of the process of the centrifuge 10.

As illustrated in FIGS. 6A and 6B, conventionally, after a steady operation mode is finished as an operation time is of the centrifuge is elapsed, the operation mode is switched from the steady operation mode to a deceleration stop mode. When deceleration of the rotation speed Nr of the rotor 14 is started, the rotation of the compressor 23 is stopped so that the temperature of the rotor 13 is not excessively (unnecessarily) cooled. Therefore, until time tg at which the rotor 14 is stopped after the operation mode is switched to the deceleration stop mode, temperature Ta of the rotor chamber 13 is gradually increased to be higher than a target temperature Ttg due to heating of the rotor 14 itself. However, as the windage loss, that is, amount of heat is decreased along with decrease of the rotation speed of the rotor 14, the temperature Ta of the rotor chamber 13 is increased only until an uncontrolled temperature T11 and it does not reach the set temperature Tset. Meanwhile, while the set temperature Tset of the rotor 14 is maintained until immediately before starting deceleration, when the operation mode is switched to the deceleration stop mode, as a gentle deceleration is performed in a state in which the windage loss is being decreased; thus, the rotor 14 is maintained for a long time in the rotor chamber 13 at a lower temperature than the set temperature Tset. Thus, the rotor 14 is excessively cooled as it is cooled until temperature T10 that is lower than the set temperature Tset due to influence from the low temperature of the rotor chamber 13.

FIGS. 7A and 7B are operation mode characteristics diagrams illustrating an example of changes in temperature control operation and operation mode of the rotor 14 of the centrifuge of the embodiment. FIG. 7A illustrates time changes of a rotation speed Nr of the rotor 14 and a rotation speed Nc of the compressor 23 from start to finish of a centrifugal process. FIG. 7B illustrates changes in temperature Ta of the rotor chamber 13 and temperature Tr of the rotor 14 by a temperature control operation from start to finish of the centrifugal process of the centrifuge 10.

Upon performing the centrifugal process, as described above, a user previously operates the panel of the operation display area 29 to input operation conditions of the centrifuge such as the rotation speed Nr of the rotor 14, the set temperature Tset of the rotor 14, the operation time is of the centrifuge, the type of the rotor 14, etc., and each inputted set value is displayed on the operation display area 29. When a start switch of the operation display area 29 is operated, the rotor 14 is driven to rotate by the electric motor 15, and the rotor 14 is driven to rotate at the inputted rotation speed Nr of the steady operation mode. When the inputted operation time ts of the centrifuge is elapsed and the steady operation mode is finished, after the finish, the operation mode is switched to the deceleration stop mode and the rotor 14 is gradually decelerated to be stopped. Preset time (ts−t0) before setting the deceleration stop mode is a stop preparation mode in which a rotation speed of the rotor 14 is set at the rotation speed Nr that is same as that of the steady operation mode.

Meanwhile, when the rotor 14 is started, the compressor 23 of the cooling apparatus 20 is driven at the rotation speed Nc illustrated in FIG. 7A and the rotor chamber 13 is cooled. In the steady operation mode, the compressor 23 is driven such that the temperature of the rotor chamber 13 is at a first target controlled temperature Ttg1 that is a steady target temperature in the steady operation mode. In this manner, the set target controlled temperature differs between the initial stage and final stage of the operation in the same operation state at the same rotation speed Nr and the temperature of the rotor chamber 13 is controlled by the cooling apparatus 20. The target controlled temperature Ttg1 is calculated by the control unit 27 based on the inputted set temperature Tset of the rotor 14. The target controlled temperature Ttg1 is set in accordance with the type, the rotation speed Nr, etc. of the rotor 14. That is, as illustrated in FIG. 5, the larger the windage loss Q, the higher the temperature of the rotor 14 itself and the more the temperature difference ΔL of the temperatures of the rotor 14 and the rotor chamber 14. Thus, setting is automatically made such that the higher the rotation speed of the rotor 14 during the operation, the lower the target controlled temperature Ttg1 of the rotor chamber 13 than the set temperature Tset of the rotor 14.

When the operation time ts of the centrifuge is elapsed and a remaining time of the steady operation mode is within the preset stop preparation time B=(ts−t0), the temperature of the rotor chamber 13 is switched to a second target controlled temperature Ttg2 that is higher than the first target controlled temperature Ttg1. The rotation speed Nr of the rotor 14 in the stop preparation time B is the same as the rotation speed in the steady operation mode. In the same operation conditions, the cooling temperature of the cooling apparatus 20 is set in two states, i.e., the first target controlled temperature and the second target controlled temperature. An amount of change made in the target controlled temperature Ttg1 for calculating the second target controlled temperature Ttg2 is calculated by the control unit 27 based on the type of the rotor 14, the rotation speed Nr of the rotor 14, etc. In addition, the stop preparation time B switched to the second target controlled temperature Ttg2 is computed by the control unit 27 based on the rotation speed Nr of the rotor 14, the set temperature Tset of the rotor, the type of the rotor 14, etc. and is variable. However, the stop preparation B time may be a certain value.

At a target controlled temperature changing time t0, before the rotor 14 is set to be in the deceleration stop mode, when the target controlled temperature of the rotor chamber 13 is switched to the second target controlled temperature Ttg2, in the stop preparation time and the deceleration stop mode, the temperature Ta of the rotor chamber 13 is increased as illustrated by a solid line, and the temperature Tr of the rotor 14 is decreased as illustrated by another solid line. When the rotor 14 is stopped, the temperature of the rotor 14 is lowered to a temperature T20.

In FIGS. 7A and 7B, the broken lines illustrate the temperature changes of the rotor chamber 13 and the rotor 14 of the existing centrifuge illustrated in FIGS. 6A and 6B. As illustrated in FIGS. 7A and 7B, when a remaining time of the steady operation mode of the rotor 14 is within the stop preparation time B, as the target controlled temperature of the rotor chamber 13 is increased to the target controlled temperature Ttg2, the temperature lowering of the temperature Tr of the rotor 14 is reduced than that of the existing control method. As a result, excessive cooling of the rotor 14 is suppressed. An amount of change of the target controlled temperature (Ttg2−Ttg1) for preventing and controlling excessive cooling may be variable based on the type, rotation speed, etc. of the rotor 14 or at a certain value.

As described above, the windage loss Q of the rotor 14 is increased as the rotation speed of the rotor 14 is increased.

Particularly, the windage loss Q is apparent when the centrifuge 10 is operated at a higher rotation speed so as to have windage loss more than near ⅛ (set rotation speed is 48% of the maximum rotation speed) of the windage loss of the highest rotation speed of the rotor 14. Thus, with taking the windage loss ⅛ as an allowable windage loss limit value, when the rotor is driven at a rotation speed so as to have windage loss exceeding this allowable limit value, the operation mode for preventing and controlling excessive cooling illustrated in FIGS. 7A and 7B is carried out.

Next, a temperature control process that is an embodiment will be described with reference to the flowchart in FIG. 8. First, whether the rotor 14 is rotating or not is determined in a step S30. When the rotor 14 is being stopped, temperature control for suspension is performed (step S40). On the other hand, when the determination is YES at the step S30 and the rotor 14 is rotating, whether an operation time is preset or not is determined (step S31). When the operation time is being set, whether the deceleration stop mode is set or not, that is, slow deceleration control (DS deceleration) by the free-run deceleration control or the variable deceleration gradient function is set or not is determined (step S32). When a deceleration stop mode (free-run deceleration control or slow deceleration control) is set, whether the operation state of the rotor 14 is currently in a decelerating state or not is determined at a step S33, and whether the rotation speed of the rotor 14 currently set is one having windage loss of ⅛ or more, that is, whether the windage loss exceeds the allowable windage loss limit value or not is determined at the step S34.

When the set rotation speed of the rotor 14 exceeds 48% of the maximum rotation speed, based on a type of the rotor 14 determined by the rotor determination unit and set rotation speed inputted by operating the operation display area 29, a preset time before starting deceleration, that is, the stop preparation time B is calculated and decided (step S35). Further, at a step S36, a process of determining an amount of change in target controlled temperature ΔT is performed, and the second target controlled temperature Ttg2 is computed by adding the amount of change ΔT to the first target controlled temperature Ttg1 of the rotor chamber 13 described above. Next, whether a remaining time of the operation time until switching to the deceleration stop mode is shorter than a preset time, that is, the stop preparation time B determined at the step S35 or not is determined (step S37). When the remaining time is smaller than the preset time, the target controlled temperature is changed to the second target controlled temperature Ttg2 determined at the step S36 (step S38), and the temperature of the rotor chamber 13 is controlled based on the changed target controlled temperature Ttg2 at a step S39.

Meanwhile, when it is determined at the step S31 that the operation time is not set, it is determined at the step S32 that deceleration is not by free-run or variable deceleration gradient function, that is, a deceleration stop mode is not set, and it is determined at the step S33 that the rotor 14 is not decelerating, temperature control for the rotating rotor at the step S39 is performed. Also, when it is determined that a set rotation speed has smaller windage loss than the allowable windage loss limit value of windage loss ⅛, and when the remaining time of the set operation time is longer than the set time determined at the step S35, the temperature control for the rotating rotor at the step S39 is performed.

As described above, the prevention and control of excessive cooling of the rotor 14 is performed only when the windage loss obtained by the type of the rotor 14 and the set rotation speed of the rotor 14 is larger than the allowable windage loss limitation value. When the set rotation speed has windage loss that is smaller than the allowable windage loss limitation value, that is, at the rotation speed as illustrated on the left side than the black circles in FIGS. 4 and 5, the amount of heat generation of the rotor 14 is small. Thus, as illustrated in FIG. 5, the target controlled temperature of the rotor chamber 13 is set at substantially the same temperature as the set temperature of the rotor 14, that is, within ±1° C. from the set temperature. In this manner, the temperature of the rotor chamber 13 is controlled such that it is maintained at a temperature close to the set temperature since before the rotor 14 is decelerated. The amount of heat generation of the rotor 14 itself is small during rotating and decelerating at a set rotation speed having windage loss smaller than the allowable windage loss limitation value, and thus the temperature of the rotor chamber 13 does not largely differ from the set temperature. Thus, when the set rotation speed has windage loss smaller than the allowable windage loss limitation value, the prevention and control of excessive cooling is not needed. Note that, while the target controlled temperature has been changed when the set rotation speed is 48% or more of the maximum rotation speed, this value is not strictly limited to this but is an indication. Thus, a different value may be used based on experiments and calculations, and whether the prevention and control of excessive cooling is performed or not may be decided in accordance with a ratio of rotation speed instead of the ratio of windage loss.

While an example of setting the set rotation speed upon operation at 48% or larger than the maximum rotation speed of the rotor has been described as an example in the embodiments described above, it is preferable that the prevention and control of excessive cooling is performed when the set rotation speed is 80% or more of the maximum rotation speed of the rotor. Further, it is preferable to perform the prevention and control of excessive cooling when the set rotation speed is 50% or more of the maximum rotation speed of the rotor. Further, it is preferable to perform the prevention and control of excessive cooling when the set rotation speed is 40% or more of the maximum rotation speed of the rotor. Further, it is preferable to perform the prevention and control of excessive cooling regardless of the type of the rotor and upon input of a value of the set rotation speed inputted via the input unit is larger than or equal to a predetermined value.

In addition, the control may be performed in accordance with only the type of the rotor determined by the rotor determination unit such that the first target controlled temperature is changed to the second target controlled temperature before the set operation time come, particularly when windage loss of the rotor is determined to be small. Further, when the set temperature inputted via the input unit is smaller than a predetermined value (for example, lower than or equal to 10° C.), the control may be performed such that the first target controlled temperature is changed to the second target controlled temperature before the set operation time is elapsed.

When the set rotation speed is larger than a predetermined value (for example, 40% or more) to the maximum rotation speed of the rotor 14, as illustrated in FIG. 4, the amount of heat generation due to the windage loss Q is large. Thus, as illustrated in FIG. 5, the set temperature of the target controlled temperature in the stable operation mode is set to be far from the set temperature, that is, a target controlled temperature Trg1. For example, the target controlled temperature Trg1 is set at a temperature lower than the set temperature by −5° C. to −15° C. Thus, the temperature of the rotor chamber 13 is controlled at a low temperature largely differing from the set temperature Tset and the temperature Ta of the rotor chamber is extremely lower than the set temperature Tset. When the rotor 14 is controlled from this state to be stopped taking a long time by free-run deceleration or slow deceleration control, the amount of heat generation is decreased as the rotation speed of the rotor is decreased; thus, it takes a long time to stop the rotor 14 while it is kept unable to increase the temperature of the rotor chamber 13, causing excessive cooling of the rotor 14. According to the foregoing, when the rotor 14 is driven to rotate at a high rotation speed that is set to exceed a predetermined value to the maximum rotation speed, the prevention and control of excessive cooling is performed.

As described above, in the embodiments illustrated in the attached drawings, when performing slow deceleration control taking a long time by free-run or valuable gradient deceleration function from a state in which the rotor 14 is rotating at a high rotation speed, by setting the target controlled temperature of the rotor chamber 13 high earlier than the timing of starting deceleration only by the stop preparation time B, the temperature of the rotor chamber 13 can be controlled to be close to the set temperature of the rotor 14; thus, excessive cooling of a sample loaded to the rotor 14 can be prevented. In this manner, lowering of process quality of the sample can be prevented.

The present invention is not limited to the foregoing embodiments and various modifications and alterations can be made within the scope of the present invention. For example, in the embodiments, two target controlled temperatures have been set to make the set temperature differ in the final stage in the deceleration stop mode of the operation and in the initial stage in the stable operation mode of the operation in accordance with the cooling capacity of the cooling apparatus 20. When the target controlled temperature is set to be higher than the second target controlled temperature Ttg2 upon switching from the stable operation mode to the deceleration stop mode, the centrifuge corresponds to three stages of target controlled temperature.

What is claimed is:

1. A centrifuge comprising:

a rotor chamber containing a rotor in which a sample is loaded;

a motor rotary driving the rotor;

a cooling unit cooling temperature of the rotor chamber;

a temperature sensor detecting the temperature of the rotor chamber;

an input unit inputting operation conditions of the rotor; and a control unit controlling the motor in a steady operation mode of rotating the rotor at a setting rotation speed and for a setting time inputted by the input unit and a deceleration stop mode of stopping the rotor by deceleration after the steady operation mode is finished, wherein the control unit controls the cooling unit such that, when the setting rotation speed is higher or equal to a predetermined value, a target controlled temperature of the rotor chamber is set from a first target controlled temperature to a second target controlled temperature that is higher than the first target controlled temperature before starting deceleration of the rotor.

2. The centrifuge according to claim 1, wherein changes in the target controlled temperature made by the control unit are performed only when the set temperature inputted by the input unit is lower than or equal to a predetermined value.

3. In the centrifuge according to claim 1, wherein, when the setting rotation speed becomes 40% or more of a maximum rotation speed, the first target controlled temperature is changed to the second target controlled temperature.

4. The centrifuge according to claim 1, wherein the cooling unit includes a compressor which compresses a cooling medium flowed out from a cooling pipe in which the cooling medium is circulated, and controls the temperature of the rotor by changing a rotation speed of the compressor.

5. The centrifuge according to claim 1, wherein the cooling unit includes a cooling pipe in which a cooling medium is circulated, and a circulating pipe sending back the cooling medium flowed out from an outlet port of the cooling pipe to an inlet port of the cooling pipe via a compressor, a bypass pipe bypassing the compressor is provided to the circulating pipe, and the temperature of the rotor chamber is controlled by adjusting a flow rate of the bypass pipe.

6. The centrifuge according to claim 1, wherein a rotation axis of the motor has a rotor identifier for identifying a type of the rotor attached to the rotation axis, and when windage loss calculated from the type of the rotor and the rotation speed of the rotor is larger than or equal to allowable windage loss limit value to windage loss of a maximum rotation speed of the rotor, the temperature of the rotor chamber is set at the second target controlled temperature.

7. The centrifuge according to claim 1, when the rotor is driven at a revolution speed higher than or equal to a limit rotation speed, the temperature of the rotor chamber is set to the second target controlled temperature.

8. The centrifuge according to claim 1, wherein, based on the type of the rotor and the rotation speed of the rotor, a stop preparation time in which the first target controlled temperature is switched to the second target controlled temperature and the second target controlled temperature are calculated.

9. The centrifuge according to claim 1, wherein the rotation axis of the motor has a rotor identifier for identifying a type of the rotor attached to the rotation axis, and when the setting rotation speed of the rotor is higher than or equal to a predetermined value, the temperature of the rotor chamber is set to the second target controlled temperature based on the type and the setting rotation speed.

10. A centrifuge comprising:

a rotor chamber containing a rotor in which a sample is loaded;

a motor rotary driving the rotor;

a cooling unit cooling temperature of the rotor chamber;

a temperature sensor detecting the temperature of the rotor chamber;

an input unit inputting operation conditions of the rotor; and a control unit controlling the motor in a steady operation mode of rotating the rotor at a setting rotation speed and for a setting time inputted by the input unit and a deceleration stop mode of stopping the rotor by deceleration after the steady operation mode is finished, wherein the control unit sets, when the setting rotation speed is higher than or equal to a predetermined value, a cooling temperature of the rotor chamber to be different between an initial stage of operation and a final stage of operation at an identical rotation speed.

11. A centrifuge comprising:

a rotor chamber containing a rotor in which a sample is loaded;

a motor rotary driving the rotor;

a rotor determining unit determining the rotor;

a cooling unit cooling temperature of the rotor chamber;

a temperature sensor detecting the temperature of the rotor chamber;

an input unit inputting operation conditions of the rotor; and a control unit controlling the motor in a steady operation mode of rotating the rotor at a setting rotation speed and a setting time inputted by the input unit and a deceleration stop mode of stopping the rotor by deceleration after the steady operation mode is finished, wherein the control unit controls the cooling unit such that a target controlled temperature of the rotor chamber is set at a second target controlled temperature that is higher than a first target controlled temperature from the first target controlled temperature before starting deceleration of the motor in accordance with the type of the rotor determined by the rotor determination unit.

12. The centrifuge according to claim 11, wherein, when the setting rotation speed inputted by the input unit is determined to be 40% or more of a maximum rotation speed of the rotor, the target controlled temperature is changed.

13. The centrifuge according to claim 11, wherein the control unit changes the target controlled temperature when the rotor determining unit determines that a windage loss of the rotor is small and a deceleration control is a free-run deceleration control or a slow deceleration control.

* * * * *